US008381837B2

(12) United States Patent
Laird et al.

(10) Patent No.: US 8,381,837 B2
(45) Date of Patent: Feb. 26, 2013

(54) DOWNHOLE TOOL DEACTIVATION AND RE-ACTIVATION

(75) Inventors: Tommy Laird, Cypress, TX (US); Richard C. Davis, Houston, TX (US)

(73) Assignee: Smith International, Inc., Houston, TX (US)

( * ) Notice: Subject to any disclaimer, the term of this patent is extended or adjusted under 35 U.S.C. 154(b) by 269 days.

(21) Appl. No.: 12/748,012

(22) Filed: Mar. 26, 2010

(65) Prior Publication Data

US 2011/0232969 A1 Sep. 29, 2011

(51) Int. Cl.
*E21B 10/32* (2006.01)

(52) U.S. Cl. ..... 175/57; 175/268; 175/269

(58) Field of Classification Search ..... 175/57, 175/268, 269
See application file for complete search history.

(56) References Cited

U.S. PATENT DOCUMENTS 4,603,745 A * 8/1986 Watvedt ..... 172/212
6,732,817 B2 5/2004 Dewey et al.
7,975,783 B2 * 7/2011 Fanuel et al. ..... 175/285

* cited by examiner

*Primary Examiner* — William P Neuder
(74) *Attorney, Agent, or Firm* — Osha Liang LLP

(57) ABSTRACT

A downhole tool including a tubular body having an upper connection and a lower connection and an axial borehole therethrough, wherein the upper and lower connections are configured to connect to a drilling assembly, at least one expandable component coupled to the tubular body and configured to selectively extend radially therefrom, and an actuation assembly configured to selectively actuate, deactuate, and reactuate the at least one component. A method of selectively actuating a downhole tool, wherein the downhole tool comprises a tubular body with an axial borehole therethrough and at least one component, the method including circulating a drilling fluid in the axial borehole of the downhole tool, actuating the at least one component, deactuating the at least one component, and reactuating the at least one component. An actuation assembly including a mandrel having an actuation chamber port, at least one drop device, a piston disposed within the mandrel and configured to move to open the actuation chamber port, at least one dart, a sleeve disposed within the mandrel and configured to move to close the actuation chamber port; and at least one biasing member configured to exert a force on the sleeve in an upstream direction.

24 Claims, 6 Drawing Sheets

DOWNHOLE TOOL DEACTIVATION AND RE-ACTIVATION

BACKGROUND OF INVENTION

1. Field of the Invention

Embodiments disclosed herein relate generally to a downhole tool. In particular, embodiments disclosed herein relate to an actuation assembly of a downhole tool to selectively open and close components of the tool.

2. Background Art

In the drilling of oil and gas wells, concentric casing strings may be installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas may be reduced. Therefore, to increase the annular space for the cementing operation, and to increase the production flow area, it may be desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation may be reached with comparatively larger diameter casing, thereby providing more flow area for the production of oil and gas.

Various methods have been devised for passing a drilling assembly, either through a cased borehole or in conjunction with expandable casing to enlarging the borehole. One such method involves the use of an expandable underreamer, which has basically two operative states. A closed or collapsed state may be configured where the diameter of the tool is sufficiently small to allow the tool to pass through the existing cased borehole, while an open or partly expanded state may be configured where one or more arms with cutters on the ends thereof extend from the body of the tool. In the latter position, the underreamer enlarges the borehole diameter as the tool is rotated and lowered in the borehole. During underreaming operations, depending upon operational requirements of the drilling assembly, cutter blocks of the underreamer may be extended or retracted while the assembly is downhole.

Movement of the cutter blocks typically involves manipulating a sleeve that is used to open or close ports to allow fluid to activate and expand the cutter blocks of the underreamer. In certain prior art applications, the sleeve is held in place with shear pins, and a ball drop device may be used to shear the pins and thereby increase pressure in the tool to move the sleeve and open the cutter block activation ports. However, once the pins are sheared, the tool stays open for the duration of the drilling interval. Therefore, such a configuration may only allow one open cycle. In some prior art applications, the tool may then be closed using a second ball drop device of a different size. However, if the deactivation ball is mistakenly dropped prior to the activation ball, the tool may be deactivated before any operations are performed. Additionally, the balls may remain in the tool as retrieval of the balls is difficult and perhaps impossible. This is also applicable in other tools which may be expanded, including but not limited to, cutting tools, spearing tools, and expandable stabilizers. Accordingly, there exists a need for an apparatus to allow the components of expandable tools to open, close, and reopen while the tool is downhole.

SUMMARY OF INVENTION

In one aspect, the embodiments disclosed herein relate to a downhole tool including a tubular body having an upper connection and a lower connection and an axial borehole therethrough, wherein the upper and lower connections are configured to connect to a drilling assembly, at least one expandable component coupled to the tubular body and configured to selectively extend radially therefrom, and an actuation assembly configured to selectively actuate, deactuate, and reactuate the at least one component.

In another aspect, the embodiments disclosed herein relate to a method of selectively actuating a downhole tool, wherein the downhole tool comprises a tubular body with an axial borehole therethrough and at least one component, the method including circulating a drilling fluid in the axial borehole of the downhole tool, actuating the at least one component, deactuating the at least one component, and reactuating the at least one component.

In another aspect, the embodiments disclosed herein relate to an actuation assembly including a mandrel having an actuation chamber port, at least one drop device, a piston disposed within the mandrel and configured to move to open the actuation chamber port, at least one dart, a sleeve disposed within the mandrel and configured to move to close the actuation chamber port; and at least one biasing member configured to exert a force on the sleeve in an upstream direction.

Other aspects and advantages of the invention will be apparent from the following description and the appended claims.

DETAILED DESCRIPTION

In one aspect, embodiments disclosed herein relate to a downhole tool having at least one component that may be actuated. Specifically, embodiments disclosed herein relate to a downhole tool having an actuation assembly that may activate, deactivate, and reactivate a downhole tool.

Figure 1:
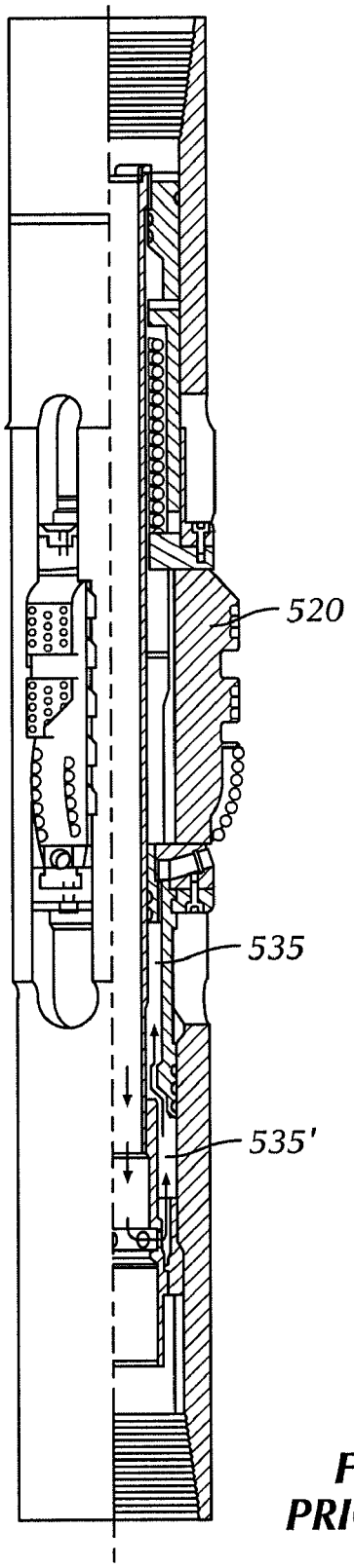
FIG. 1 PRIOR ART
FIG. 1 shows a conventional downhole tool.

Downhole tools with at least one moveable component, such as reaming tools, cutting tools, spearing tools, and expandable stabilizers are known in the art. Those of ordinary skill in the art will appreciate the wide variety of downhole tools having at least one moveable component that may extend and retract from a tubular body in response to a change in differential fluid pressure. FIG. 1 shows a downhole tool disclosed in U.S. Pat. No. 6,732,817. U.S. Pat. No. 6,732,817, which is assigned to the assignee of the present application, and is incorporated by reference in its entirety, discloses a downhole tool having at least one component, specifically a moveable arm 520, coupled to the tool. The component is actuated by fluid pressure in an actuation chamber, specifically piston chamber 535.

The downhole tool disclosed in U.S. Pat. No. 6,732,817 and illustrated in FIG. 1 is one example of a downhole tool that may be activated, deactivated, and reactivated by embodiments of the actuation assembly disclosed herein. The tool shown in FIG. 1 is in an actuated position. Although the downhole tool of U.S. Pat. No. 6,732,817 has components that translate, those of ordinary skill will appreciate that embodiments disclosed herein may be used with components that extend and retract by pivoting, rotating, or translating in response to a change in differential fluid pressure. Actuation assemblies in accordance with embodiments disclosed herein may be used with downhole tools having a tubular body with an upper and lower connection. The connections may be threaded connections.

Overview

A downhole tool having an actuation assembly as described herein may be activated, deactivated, and reactivated in accordance with embodiments disclosed herein.

A method of activating a downhole tool in accordance with embodiments of the present disclosure includes circulating a drilling fluid in the axial borehole of the downhole tool. A drop device, such as a ball, is inserted into the axial borehole of an actuation assembly where gravity and/or fluid pressure may move the drop device downstream until the drop device is seated in a moveable piston. Pressure increases upstream from the seated drop device until a predetermined pressure is achieved. At least one piston locking device releases at approximately a predetermined pressure rating, and the piston disposed in the axial borehole moves to open an actuation chamber port. The circulating fluid fills an actuation chamber and actuates at least one moveable component, for example, an extendable reaming block or arm.

The downhole tool is deactivated in accordance with embodiments of the present disclosure by inserting a dart in the axial borehole of the actuation assembly where gravity and/or fluid pressure may move the dart through the axial borehole. When the dart is seated in a sleeve disposed in the mandrel upstream from the sleeve, the pressure increases upstream. At least one sleeve locking device releases at approximately a predetermined pressure rating, and the sleeve moves downstream to close the actuation chamber port. The drilling fluid is blocked from entering the actuation chamber, and the loss of fluid pressure deactuates the moveable component(s) of the downhole tool. Increased pressure may then burst a burst disk disposed across a cross-section of the dart at approximately a predetermined pressure rating of the burst disk. After the burst disk bursts, the drilling fluid may continue to flow through the axial borehole.

Reactivating the downhole tool in accordance with embodiments of the present disclosure includes moving the sleeve to open the actuation chamber port. Moving the sleeve may be accomplished by altering the force of the drilling fluid acting on the sleeve. A biasing member may exert more force on the sleeve in the upstream direction than the downstream direction when the fluid force is below a predetermined value. Alternatively, the dart may be removed with the use of a fishing device, and a biasing member may move the sleeve to reopen the actuation chamber port. Once the actuation chamber port is open, fluid may flow into the actuation chamber and reactuate the component(s) of the downhole tool.

Figure 2:
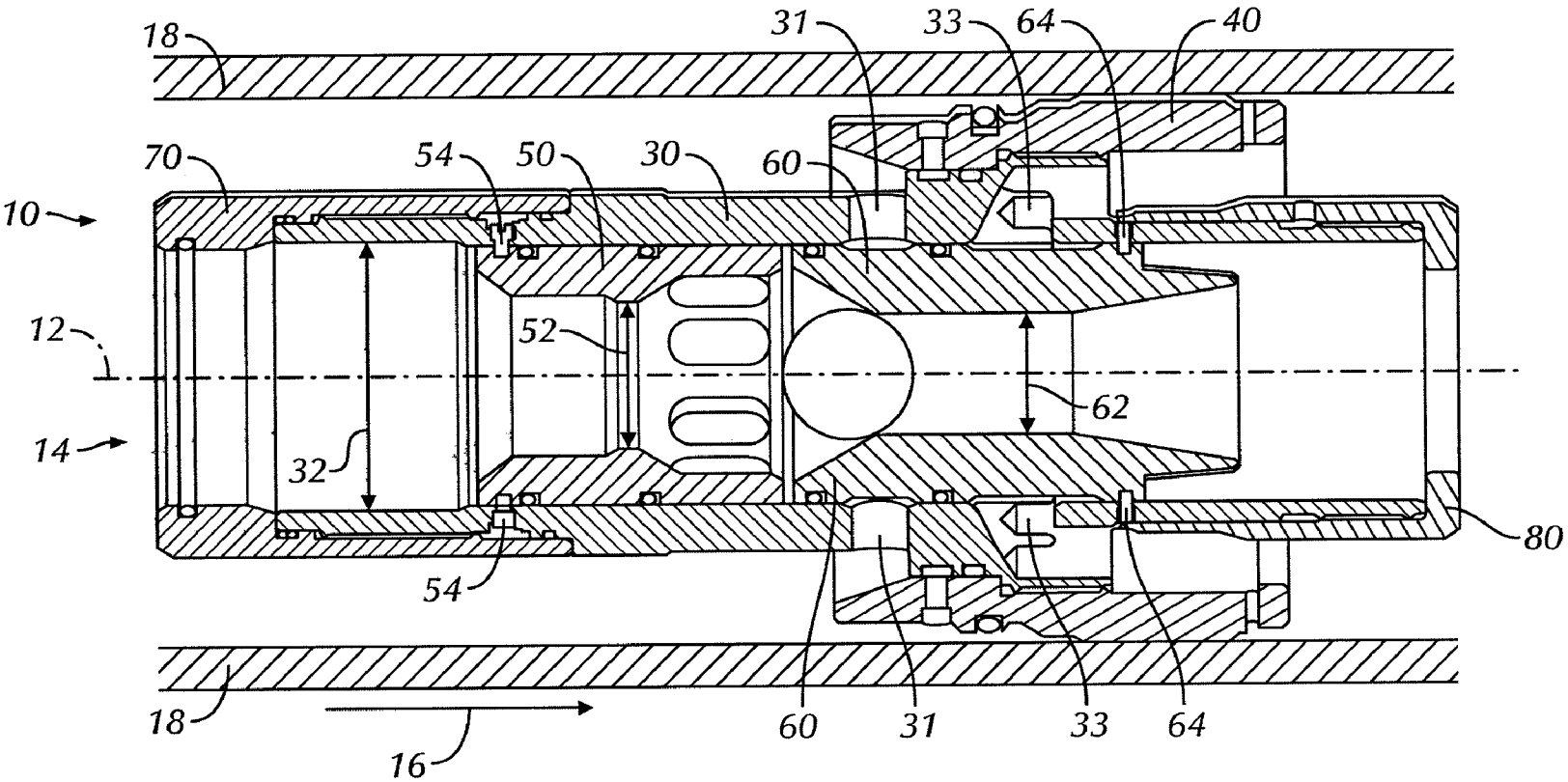
FIG. 2 shows a cross-sectional view of an actuation assembly of a downhole tool in accordance with an embodiment of the present disclosure.

FIGS. 2-6 illustrate an actuation assembly 10 that may be located below the moveable arms 520 of the downhole tool, as shown in FIG. 1. FIG. 2 shows a cross-sectional view of the actuation assembly 10 of the downhole tool prior to an initial activation. The actuation assembly 10 controls the activation, deactivation, and reactivation of the downhole tool. Activation, as used herein, refers to a first movement, actuation, of a component of the downhole tool, such that the downhole tool may perform at least one intended function of the tool. Deactivation, as used herein, refers to a second movement, deactuation, of a component of the tool, such that the downhole tool ceases to perform at least one intended function of the tool. Reactivation, as used herein, refers to a third movement, reactuation, of a component of the tool, such that the tool may resume performing at least one intended function stopped by the deactivation.

Actuation assembly 10 includes a lower mandrel 30, a deflector cap 40 disposed around the lower mandrel 30, a sleeve 50 disposed inside the bore 32 of the lower mandrel 30, a piston 60 located downstream from the sleeve 50, an upper cap 70 disposed around the upstream end of the lower mandrel 30, and a lower cap 80 disposed around the downstream end of the lower mandrel 30. Actuation assembly 10 is located inside a tubular body 18. The sleeve 50 and the piston 60 are located inside the lower mandrel 30. The sleeve 50 is located upstream from the piston 60. An arrow 16 indicates the direction of the flow of fluid through an actuation assembly borehole 14. Prior to activation, the actuation assembly borehole 14 is unobstructed through the central axis 12 of the downhole tool. Fluid may flow through the borehole 14 to the lower parts of the drillstring or the bottom hole assembly ("BHA"). The actuation assembly borehole 14, as used herein, refers to the central opening through the multiple components of the actuation assembly, including the lower mandrel 30, the deflector cap 40, the sleeve 50, the piston 60, the upper cap 70, and the lower cap 80. The minimum diameter of the piston bore 62 may be less than the minimum diameter of the sleeve bore 52.

Initially, the sleeve 50 may be axially secured to the lower mandrel 30 by a sleeve locking device 54 and the piston 60 may be axially secured to the lower mandrel 30 by a piston locking device 64. In one embodiment, the sleeve and piston locking devices 54 and 64 may be shear pins. Those of ordinary skill in the art will appreciate that a locking device may include any device known in the art for axially securing a moveable part within the body of a downhole tool prior to a controlled release.

FIG. 2 illustrates multiple sleeve locking devices 54 and piston locking devices 64 on both the sleeve 50 and the piston 60. Those of ordinary skill in the art will appreciate that a single sleeve locking device 54 may be used to axially secure the sleeve 50 and a single piston locking device 64 may be used to axially secure the piston 60. The total number of the sleeve locking devices 54 and the piston locking devices 64 may vary. The total pressure needed to release the sleeve 50 or the piston 64 depends on the combined release pressure of all the sleeve locking devices 54 or the piston locking devices 64. For example, if the sleeve 50 is initially held axially in place using six shear pins, then the total pressure needed to release the sleeve locking devices 54 will be no more than the sum of the pressure needed to release each sleeve locking device 54 individually. Additionally, if the piston 60 is initially held axially in place using multiple shear pins, then the total pressure needed to release the piston locking devices 64 will be no more than the sum of the pressure needed to release each piston locking device 64 individually.

Activation

Fluid flows down a wellbore through a drillstring (not shown) and into the actuation assembly borehole 14 of the downhole tool. Prior to activation, the fluid follows the central axis 12 of the parts shown in FIG. 2. The piston 60 blocks the actuation chamber port 31 and the flow diversion port 33 located in the side walls of the lower mandrel 30 prior to actuation.

Figure 3:
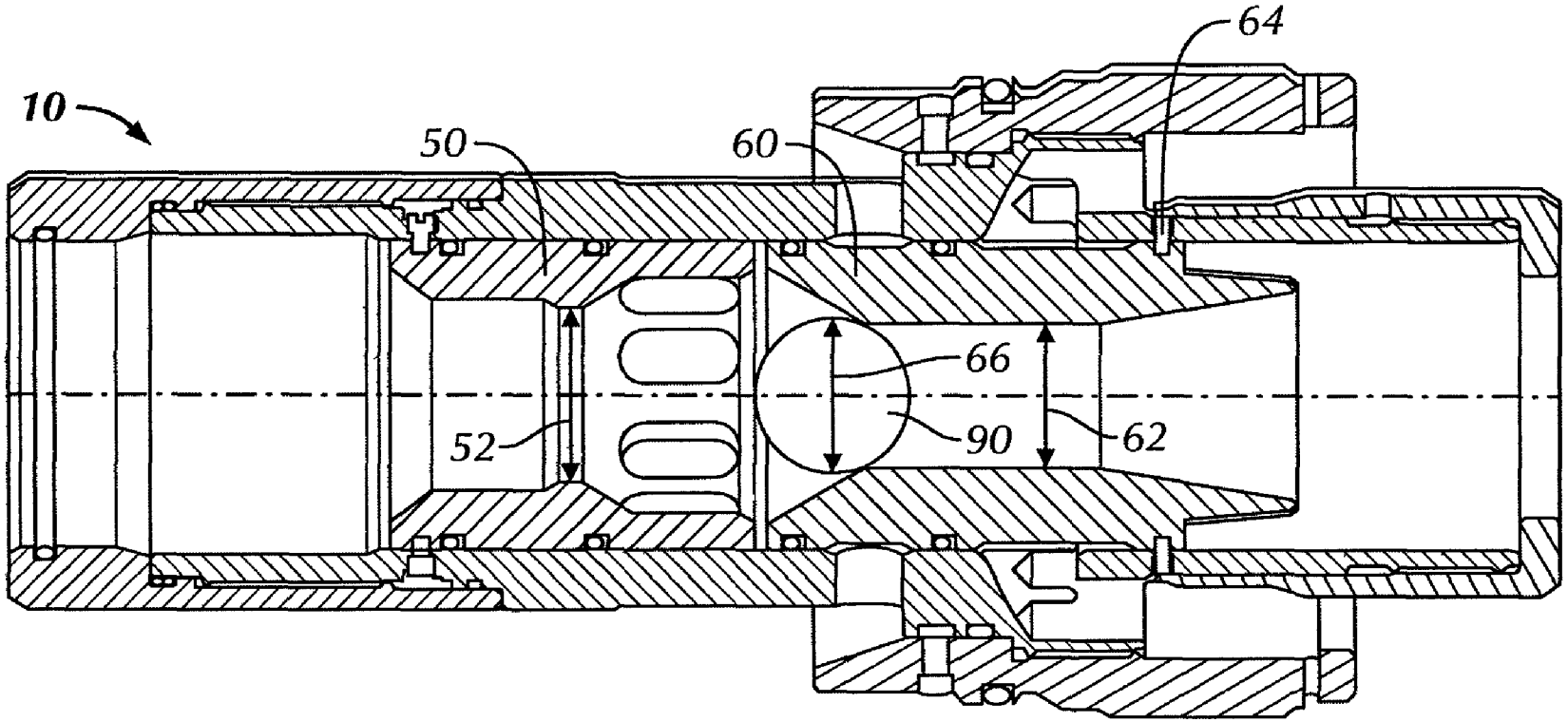
FIG. 3 shows a cross-sectional view of an actuation assembly of a downhole tool prior to activation in accordance with an embodiment of the present disclosure.

FIG. 3 shows a cross-sectional view of the actuation assembly 10 prior to an initial activation and after a drop device 90 has been dropped. The drop device 90 may be a ball, as illustrated in FIG. 3. The drop device 90 is designed to pass through the sleeve 50. For example, the sleeve bore 52 has a larger diameter than the drop device 90. After the drop device 90 is inserted into the actuation assembly 10 and passes through the sleeve bore 52, the drop device 90 is seated in an upper end of the piston 60. The piston 60 includes a seat 66 with a cross-section configured to receive the drop device 90. The drop device 90 located in the piston seat 66 prevents the flow of fluid through the piston bore 62. In one embodiment, the piston seat 66 is conical with a portion having a diameter smaller than the diameter of drop device 90, for example a ball. After the drop device 90 is seated in the piston 60, the bore 62 of the piston 60 is blocked, and thus, the pressure acting on the drop device 90 and the piston 60 increases.

Figure 4:
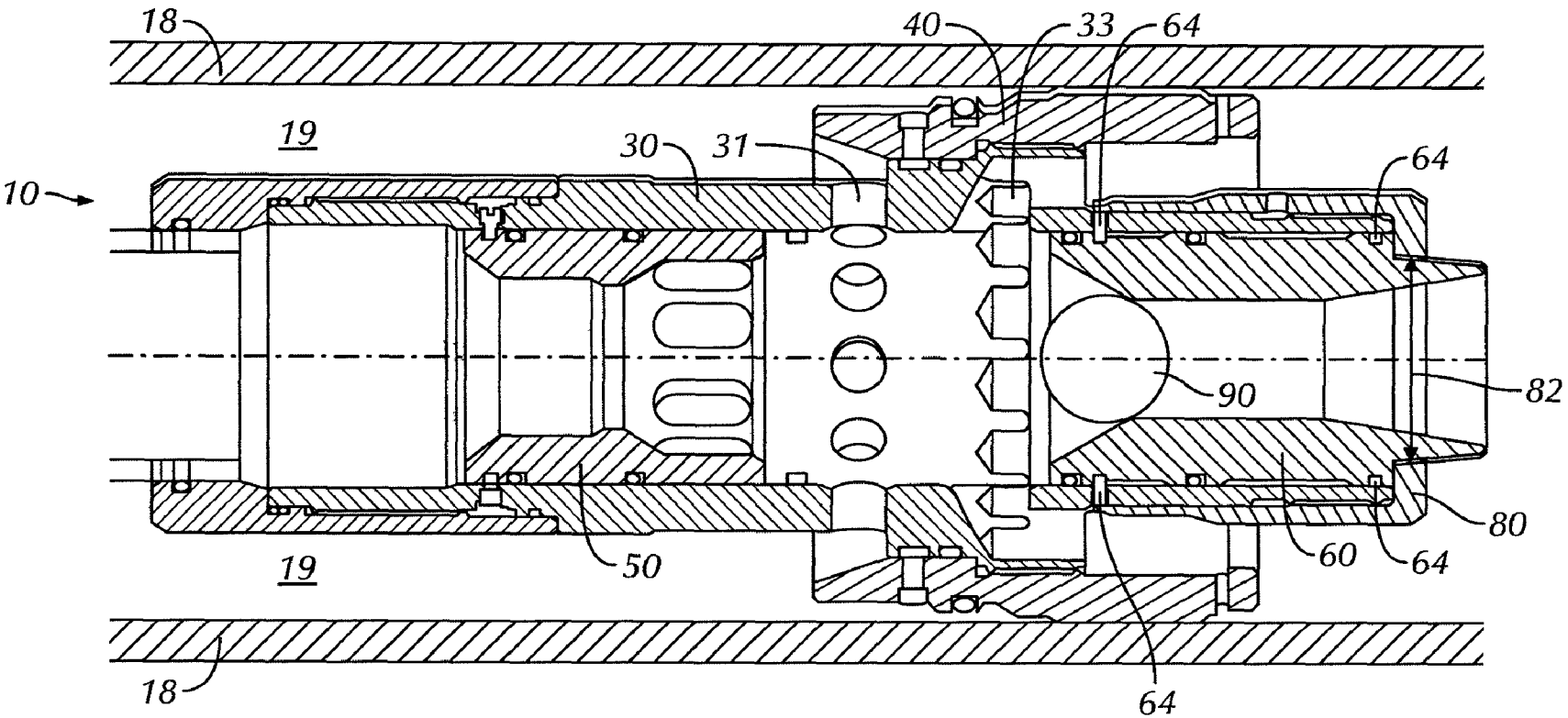
FIG. 4 shows a cross-sectional view of an actuation assembly of a downhole tool after activation in accordance with an embodiment of the present disclosure.

Referring to FIG. 4, a cross-sectional view of actuation assembly 10 of a downhole tool is shown after activation. When the pressure increases above the obstructed piston, a blockage caused by the drop device 90, the piston locking device(s) 64 may be released. FIG. 4 illustrates one embodiment of the piston locking device 64, in which the piston locking device 64 is a shear pin. FIG. 4 shows the shear pin after shearing at a predetermined actuation pressure. Therefore, each piece of the sheared shear pin is labeled as a locking device 64 in order to accurately label the results of the increased pressure. Additionally, while multiple piston locking devices 64 are illustrated in FIGS. 3 and 4, those of ordinary skill in the art will appreciate that only one locking device or more may be used.

The piston locking device 64 has a pressure rating that describes an approximate amount of pressure required to release the piston locking device 64. The predetermined pressure rating of the piston locking device 64 is selected based on parameters such as the operating pressures of pumps, valves, mud motors, etc. For example, the pressure rating cannot be higher than acceptable working pressures of other elements in the fluid system, such that other elements may be damaged from increased pressure needed to release the piston locking device 64. Additionally, the predetermined pressure rating cannot be greater than the pressure capabilities of pumps used for pumping mud or fluids downhole.

The release pressure requirements may be designed into a single locking device or distributed among multiple devices. In one embodiment, the locking devices are shear pins. The pins are selected and/or designed to shear at a predetermined value. Once the piston locking devices 64 release, e.g. shear, by increasing pressure acting on the piston obstructed by the drop device 90, the piston 60 moves in the downstream direction. The downward movement of the piston 60 may be stopped by a lower cap 80 that is attached to the lower end of the lower mandrel 30. In one embodiment, the lower cap 80 has a threaded connection with the lower mandrel 30.

After the drop device is seated in the piston 60 and/or the piston 60 is moved down and seated in the lower cap 80 as shown in FIG. 4, fluid flow is restricted through bore 82 of the lower cap 80.

The axial movement in the downstream direction of the piston 60 opens the actuation chamber port 31 and the flow diversion port 33 in the lower mandrel 30. The fluid may flow through the flow diversion port 33 and the actuation chamber port 31 located in the lower mandrel 30. The fluid may exit the actuation chamber port 31 and the flow diversion port 33 of the lower mandrel 30, and be directed by the deflector cap 40 located around the lower mandrel 30. For example, the actuation chamber port 31 may allow fluid to exit the lower mandrel 30 and be directed by the deflector cap 40 into an actuation chamber 19. The actuation chamber 19 may be located between the tubular body 18 and the actuation assembly 10. The pressure build up of fluid in the actuation chamber 19 may actuate the downhole tool above (not shown). For example, expandable reamer blocks or arms may be actuated or extended outward. The flow diversion port 33 may allow fluid to be redirected around the piston 60, where bore 62 may be blocked by the drop device 90. The flow diversion port 33 directs fluid around the lower portion of the lower mandrel 30 as well as the lower cap 80.

Deactivation

Figure 5:
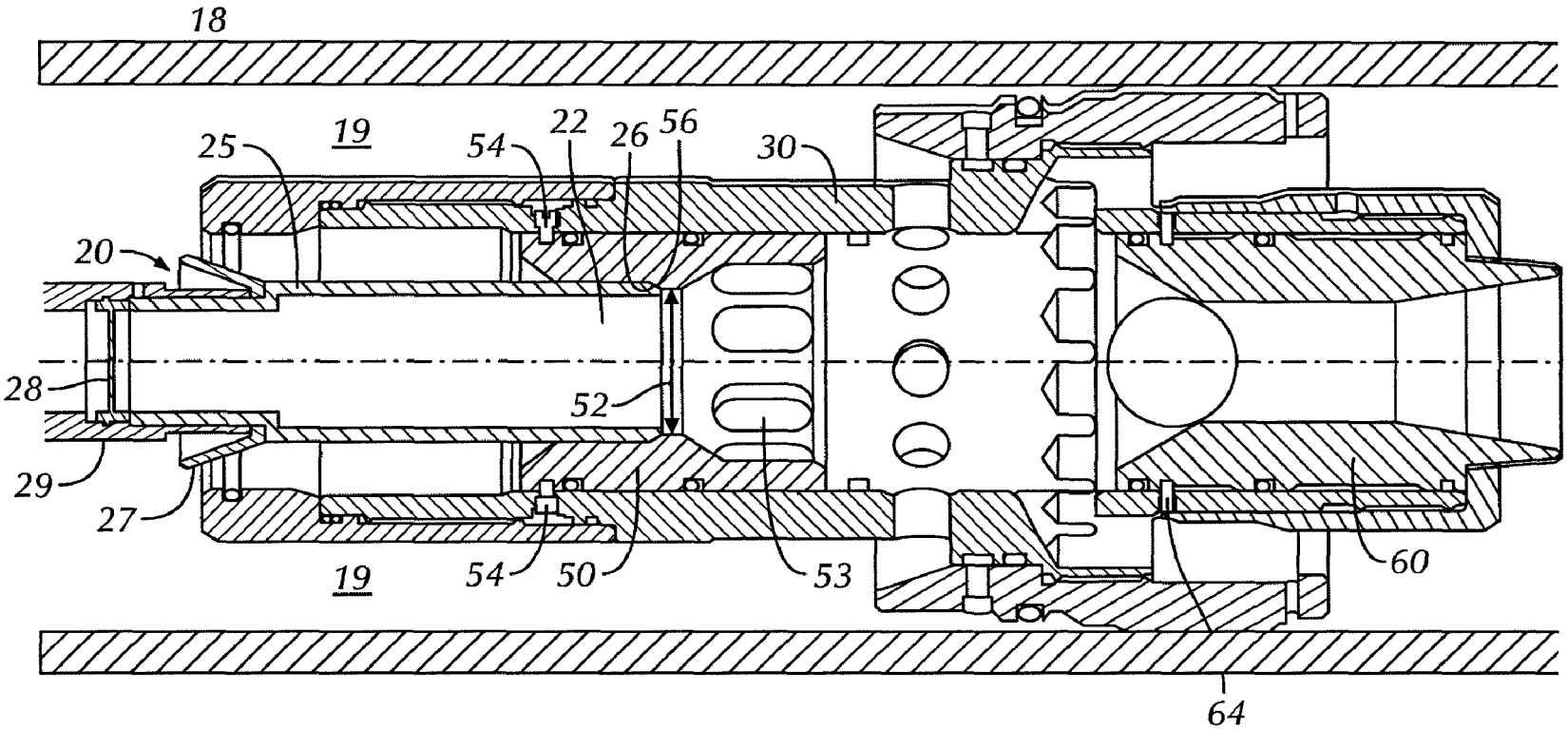
FIG. 5 shows a cross-sectional view of an actuation assembly of a downhole tool prior to a deactivation in accordance with an embodiment of the present disclosure.

FIG. 5 shows a cross-sectional view of an actuation assembly 10 immediately prior to deactivation of a downhole tool. FIG. 5 shows a dart 20 that may be inserted into the flow of fluid upstream of the actuation assembly 10 to deactivate the downhole tool. The dart 20 includes a cylindrical body 25, a cup 27, a burst disk 28 disposed across the cross-section of the dart throughbore 22, and a dart upper cap 29. The cylindrical body 25 may have a height that is greater than the diameter. The throughbore 22 may have a smaller cross-section than the bore 52 of the sleeve 50. A smaller cross section may restrict flow. The cup 27 increases the cross-sectional area of the dart 20 which gives the fluid more area to exert a pressure force on the dart 20. Thus, the cup 27 helps the fluid push the dart 20 down the drillstring (not shown). The cup 27 may further act as a plug, increasing an outer diameter of the dart 20 to fill more or all of the actuation assembly bore 14. The dart upper cap 29 may be configured to cooperate with a fishing grapple. Specifically, the dart upper cap 29 may have a head (not shown) at the upstream end of the dart upper cap 29 with a larger cross-sectional area than the rest of the dart upper cap 29. The head may additionally have an undercut feature (not shown) to assist in a fishing operation. The dart upper cap 29 may also assist in holding the burst disk 28 and the cup 27 in place.

The dart 20 is inserted into the drillstring (not shown) at a point upstream from the downhole tool disclosed herein. The fluid pressure pushes the dart 20 through the drillstring and into the actuation assembly 10 where the dart 20 seats in a seat 56 of the sleeve 50. A corresponding surface 26 of the dart 20 is configured to engage the seat 56 of the sleeve 50. In one embodiment, both surfaces 26 and 56 are conical in shape. In other embodiments, surface 26 and seat 56 may have corresponding profiles for engagement.

The dart 20 blocks fluid flow once the dart 20 is seated in the sleeve 50 causing fluid pressure to increase upstream from the dart 20. When the pressure acting on the seated dart and sleeve reaches a predetermined level, the sleeve locking device(s) 54 releases. When the sleeve locking device(s) 54 release(s), the sleeve 50 moves axially in the downstream direction within the lower mandrel 30.

Figure 6:
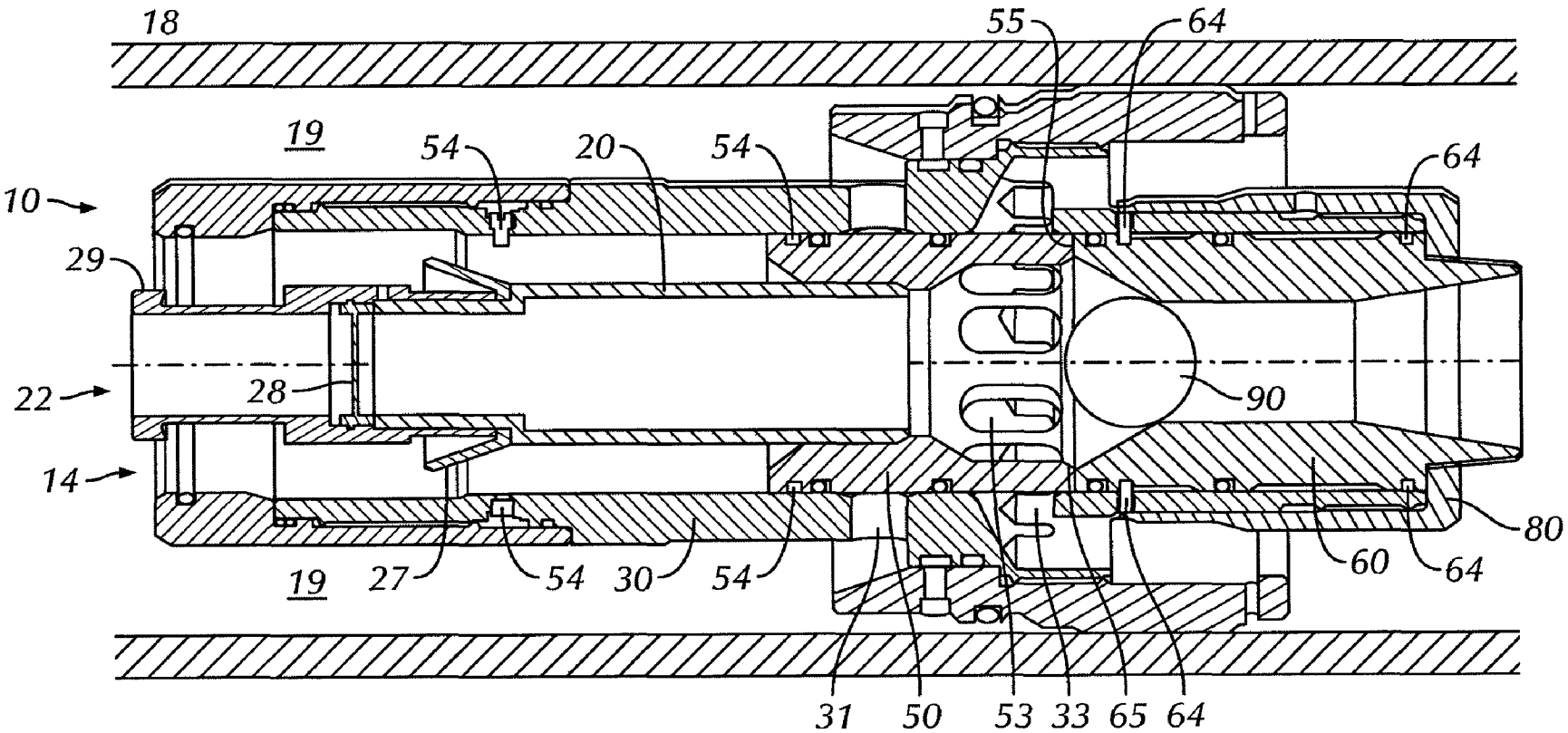
FIG. 6 shows a cross-sectional view of an actuation assembly of a downhole tool after a deactivation in accordance with an embodiment of the present disclosure.

Referring to FIG. 6, a cross-sectional view of an actuation assembly 10 is shown after deactivation. In one embodiment, the sleeve 50 is seated such that a lower surface 55 of sleeve 50 contacts an upper surface 65 of piston 60. The sleeve 50 blocks the actuation chamber port 31 and restricts the flow of fluid into the actuation chamber 19. The actuation chamber 19 loses fluid pressure causing the downhole tool to deactuate, e.g., the moveable arms (not shown) retract.

The burst disk 28 covers the cross-sectional area of the throughbore 22 of the dart 20. The burst disk 28 and the cup 27 of the dart 20 may be designed such that the burst disk 28 and the cup 27 block fluid flow down the axial borehole 14 of the downhole tool up to a predetermined pressure. The predetermined pressure rating of the burst disk 28 is higher than the pressure rating of the sleeve locking device(s) 54. Therefore, the burst disk 28 may remain intact during deactivation as the pressure increases upstream from the dart 20 and the sleeve 50, which causes the sleeve locking device(s) 54 to release. After the sleeve 50 and the dart 20 move downstream, the pressure may continue to increase in pressure upstream from the burst disk 28. Once the predetermined pressure is reached, the burst disk 28 yields, allowing fluid to flow through the throughbore 22 of the dart 20. The fluid flows through a port 53 in the sleeve 50 that is aligned with the flow diversion ports 33 in the lower mandrel 30. The fluid flows around the piston 60 blocked by the activation drop device 90 and continues down the drillstring or BHA. The burst disk 28 is preferably designed to break, or burst, at a predetermined pressure rating. Bursting the burst disk 28 at a predetermined pressure may be achieved through a choice in thickness, material, or mounting configuration.

The predetermined pressure rating for the burst disk 28 may be greater than the total pressure rating of the sleeve locking device(s) 54. The sleeve locking device(s) 54 may release prior to the burst disk 28. The release of the sleeve locking device(s) 54, the piston locking device(s) 64, and the burst disk 28 may be controlled by an operator controlling the flow of fluid. For example, fluid pressure may be adjusted by an operator by adjusting the pumping pressure. Therefore, an operator at the surface of a wellbore may control the timing of the release of the sleeve locking device(s) 54, the piston locking device(s) 64, and the burst disk 28. However, the order of release is determined by the design of the sleeve locking device(s) 54, the piston locking device(s) 64, the burst disk 28 installed on the dart 20, and the order that the drop device 90 and the dart 20 are dropped. For example, if the dart 20 is dropped prior to drop device 90, then the sleeve locking device(s) 54 may release prior to the piston locking device(s) 64, causing the lower surface 55 of the released sleeve 50 to act against the upper surface 65 of the secured piston 60. Depending on the pressure ratings of the burst disk 28 and the piston locking device(s) 64, the burst disk 28 or the piston locking device(s) 64 may yield first.

Reactivation

Reactivation of the downhole tool is achieved by reopening the actuation chamber port 31 and filling the actuation chamber 19 with drilling fluid. The sleeve 50 may move in an upstream direction in order to open the actuation chamber port 31. In one embodiment, a biasing member (not shown), e.g. a spring, is used to overcome the pressure of the circulating drilling fluid acting on the sleeve 50.

In one embodiment, a compression spring (not shown) is subject to compressive forces between the sleeve 50, after deactivation, and a downstream location of the lower mandrel 30. In an alternative embodiment, an extension spring (not shown) is subject to tension forces between the sleeve 50, after deactivation, and an upstream location of the lower mandrel 30. In a third embodiment, a compression spring (not shown) may be subject to compressive forces between the sleeve 50, after deactivation, and the piston 60. In all three embodiments, the spring (not shown) may exert a force on the sleeve 50 in an upstream direction.

With respect to deactivation, in one embodiment where a biasing member acts on the sleeve 50, the fluid force acting in the downstream direction may be required to maintain the deactivation of the downhole tool after the burst disk 28 has released. The throughbore 22 may have a smaller cross-section than the rest of the actuation assembly borehole 14. Therefore, the reduced throughbore 22 and the cup 27 partially restrict the flow of fluid and assist in increasing the fluid force without blocking the flow of the drilling fluid to lower parts of the downhole tool, drillstring, and/or BHA.

The biasing member (not shown) having a sufficient coefficient k may be able to overcome a predetermined total downstream force, i.e. the combination of fluid and gravitational forces, acting on the sleeve 50 and the dart 20, particularly the cup 27. Therefore, decreasing the fluid force acting on the sleeve 50 and the dart 20 may reduce the total downstream force and cause the sleeve 50 and the dart 20 to move upstream, open the actuation chamber port 31, and reactivate the downhole tool. Decreasing the fluid force may include varying the properties of the drilling fluid, e.g. flow rate or viscosity. On the other hand, increasing the fluid force may deactivate the downhole tool.

In one reactivation embodiment, the fluid pressure acting on the sleeve 50 may be reduced by adjusting the mud pump. When the pumping pressure is reduced, the force of the biasing member may exceed the fluid force and cause the sleeve 50 to move axially upstream. When the sleeve 50 moves a selected distance upstream, the actuation chamber port 31 is opened and the tool reactivates. The sleeve 50 may or may not move to the initial axial location of the sleeve. For example, the sleeve 50 may move a minimal distance upstream so that fluid may flow through port 53 of sleeve 50 prior to flowing though the actuation chamber port 31 of the mandrel 30. Alternatively, the sleeve 50 may move further upstream allowing the fluid to flow below the sleeve 50 prior to flowing through actuation chamber port 31. Increasing and decreasing the fluid force from the surface may reactivate and deactivate the downhole tool multiple times.

Alternatively, the dart 20 may be removed from the actuation assembly 10 in order to reactivate the downhole tool. There may be numerous advantages to removing the dart 20 to reactivate the downhole tool. For example, the biasing member may be capable of overcoming the total downstream force acting only on the sleeve 50. Removing the dart 20 may also reduce the sensitivity of the actuation assembly 10 to changes in the fluid force.

In one reactivation embodiment, a fishing grapple may be lowered down the drillstring to the downhole tool. As discussed above, the dart upper cap 29 is configured to engage a fishing grapple. Therefore, the fishing grapple may attach to the dart upper cap 29 and the dart 20 may then be pulled upstream so that the dart 20 does not obstruct or exert a force on the sleeve 50. The force of the biasing member may be greater than the total downstream force, thereby reactivating the downhole tool. The bore 52 of the sleeve 50 may have a larger cross-section than the throughbore 22 of the dart 20, allowing decreased fluid force on the sleeve 50 when the dart 20, having a restricted throughbore 22, is removed. Thus, the spring force may be greater than the opposing fluid force. In some embodiments, the dart 20 may be pulled to the surface of the wellbore. To deactivate the downhole tool after reactivation, an operator may drop the same dart 20 that was fished from the actuation assembly 10, or the operator may drop a dart 20 having an intact burst disk 28. Through dropping and retrieving darts, multiple iterations of deactivation and reactivation may occur.

Method of Selectively Actuating a Downhole Tool

Referring generally to FIGS. 1-6, a method of selectively actuating a downhole tool includes circulating a drilling fluid in the axial borehole 14 of an actuation assembly 10 of the downhole tool. To activate the downhole tool, a drop device 90, such as a ball, is inserted into the axial borehole 14 of the actuation assembly 10. Gravity and/or fluid force may move the drop device 90 downstream until the drop device 90 is seated in a moveable piston 60. Pressure increases upstream from the seated drop device 90 until a predetermined pressure is achieved. At least one piston locking device 54 releases at approximately a predetermined pressure rating, and the piston 60, disposed in the lower mandrel bore 34, moves to open an actuation chamber port 31. The circulating fluid fills an actuation chamber 19. The increase in fluid pressure may actuate at least one moveable component, for example, an extendable reaming block or arm.

The downhole tool is deactivated by inserting a dart 20 in the axial borehole 14 of the actuation assembly 10. Gravity and/or fluid pressure may move the dart through the axial borehole 14 until the dart 20 is seated in a sleeve 50 disposed in the mandrel 30. Pressure increases upstream from the seated dart 20 until the pressure reaches approximately the pressure rating of the sleeve locking device(s) 54. The sleeve locking device(s) 54 may shear and the sleeve 50 moves to close the actuation chamber port 31. The drilling fluid is blocked from entering the actuation chamber 19, and the loss of fluid pressure deactuates the moveable component(s) of the downhole tool. Increased pressure upstream from the seated dart 20 may cause a burst disk 28 disposed across a cross-section of the throughbore 22 of the dart 20 to burst at approximately the predetermined pressure rating. After the bursting the burst disk 28, the drilling fluid may continue to flow through the downhole tool.

Reactivating the downhole tool includes moving the sleeve 50 to open the actuation chamber port 31. Moving the sleeve 50 may be accomplished by altering the fluid force acting on the sleeve 50. A biasing member (not shown) may then exert more force on the sleeve 50 in the upstream direction than the downstream direction. Alternatively, the dart 20 may be removed with the use of a fishing device (not shown), and a biasing member (not shown) may move the sleeve 50 to reopen the actuation chamber port 31. Once the actuation chamber port 31 is open, fluid may flow into the actuation chamber 19 and reactuate the component(s) of the downhole tool.

Advantageously, embodiments disclosed herein provide for an actuation assembly that is capable of activation, deactivation, and reactivation without stopping the flow of fluid to downstream parts of the drillstring or BHA. Embodiments disclosed herein additionally provide for multiple iterations of deactivation and reactivation, thus, allowing a downhole tool to be used more than one time without removing the tool from the wellbore to reset the actuation assembly.

The embodiments disclosed herein advantageously provide an actuation assembly capable of reactivating a downhole tool after deactivation. Thus, the downhole tool may not have to be removed from the well in order to use the downhole tool again. Additionally, in some embodiments, the dart for deactivation is retrievable through a fishing operation allowing for reactivation. The embodiments disclosed herein allow for greater control of the activation, deactivation, and reactivation forces and timing.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A downhole tool comprising:

a tubular body comprising an upper connection and a lower connection and an axial borehole therethrough, wherein the upper and lower connections are configured to connect to a drilling assembly;

at least one expandable component coupled to the tubular body and configured to selectively extend radially therefrom; and an actuation assembly configured to selectively actuate, deactuate, and reactuate the at least one component, the actuation assembly having at least one dart, and a sleeve disposed within the tubular body and configured to move to close an actuation chamber port.

2. The tool of claim 1, wherein the actuation assembly comprises:

at least one drop device; and a piston disposed within the tubular body and configured to move to open an actuation chamber port.

3. The tool of claim 2, further comprising at least one piston locking device, wherein prior to an activation, the at least one piston locking device is configured to maintain an axial position of the piston relative to the actuation chamber port.

4. The tool of claim 1, further comprising at least one sleeve locking device, wherein prior to a deactivation, the at least one sleeve locking device is configured to maintain an axial position of the sleeve relative to the actuation chamber port.

5. The tool of claim 1, wherein the dart comprises a throughbore and burst disk having a predetermined pressure rating.

6. The tool of claim 5, wherein the predetermined pressure rating of the burst disk is greater than a pressure rating of the sleeve locking device.

7. The tool of claim 6, wherein a first minimum cross-sectional area of the axial borehole prior to the deactivation is substantially the same as a second minimum cross-sectional area after the deactivation.

8. The tool of claim 1, wherein the actuation assembly further comprises at least one biasing member configured to exert a force on the sleeve in an upstream direction.

9. The tool of claim 8, wherein the actuation assembly further comprises a fishing device configured to remove the dart in from the actuation assembly.

10. The tool of claim 2, wherein the actuation chamber port is fluidly connected to an actuation chamber.

11. The tool of claim 1, wherein the downhole hole tool is an underreamer comprising at least one expandable arm assembly.

12. The tool of claim 1, wherein the downhole tool is a cutting tool.

13. A method of selectively actuating a downhole tool, wherein the downhole tool comprises a tubular body with an axial borehole therethrough and at least one component, the method comprising:

circulating a drilling fluid in the axial borehole of the downhole tool;

actuating the at least one component;

deactuating the at least one component by causing a sleeve disposed in the tubular body to move to close an actuation chamber port and block the drilling fluid from entering the actuation chamber; and reactuating the at least one component.

14. The method of claim 13 wherein actuating the at least one component comprises:

inserting a drop device in the axial borehole;

moving a piston disposed in the tubular body to open an actuation chamber port; and filling the actuation chamber with the drilling fluid.

15. The method of claim 13 wherein deactuating the at least one component comprises:

inserting a dart in the axial borehole.

16. The method of claim 15 further comprising:

bursting a burst disk having a predetermined pressure rating disposed across a cross-section of the dart.

17. The method of claim 15 wherein reactuating the at least one component comprises:

moving the sleeve disposed in the tubular body to open the actuation chamber port; and filling the actuation chamber with the drilling fluid.

18. An actuation assembly comprising:

a mandrel comprising an actuation chamber port;

at least one drop device;

a piston disposed within the mandrel and configured to move to open the actuation chamber port;

at least one dart;

a sleeve disposed within the mandrel and configured to move to close the actuation chamber port; and at least one biasing member configured to exert a force on the sleeve in an upstream direction.

19. The tool of claim 18, further comprising at least one piston locking device, wherein prior to an activation, the at least one piston locking device is configured to maintain an axial position of the piston relative to the actuation chamber port.

20. The tool of claim 18, further comprising at least one sleeve locking device, wherein prior to a deactivation, the at least one sleeve locking device is configured to maintain an axial position of the sleeve relative to the actuation chamber port.

21. The tool of claim 18, wherein the dart comprises a throughbore and burst disk having a predetermined pressure rating.

22. The tool of claim 21, wherein the predetermined pressure rating of the burst disk is greater than a pressure rating of a sleeve locking device.

23. The tool of claim 18, wherein the actuation assembly further comprises a fishing device configured to move the dart in an upstream direction.

24. The tool of claim 18, wherein the actuation chamber port is fluidly connected to an actuation chamber.

* * * * *